US005485711A

United States Patent [19]

Suzuki et al.

[11] Patent Number: 5,485,711

[45] Date of Patent: Jan. 23, 1996

[54] BINDING MACHINE

[75] Inventors: Seiichi Suzuki; Keijiro Murayama, both of Tokyo, Japan

[73] Assignee: Max Co., Ltd., Tokyo, Japan

[21] Appl. No.: 293,249

[22] Filed: Aug. 19, 1994

[30] Foreign Application Priority Data

Aug. 20, 1993 [JP] Japan ..... 5-049912 U
Aug. 20, 1993 [JP] Japan ..... 5-049913 U

[51] Int. Cl.[6] ..... B65B 61/14

[52] U.S. Cl. ..... 53/138.4; 53/138.3; 53/417; 53/583

[58] Field of Search ..... 53/138.2, 138.3, 53/138.4, 390, 417, 583

[56] References Cited

U.S. PATENT DOCUMENTS

| | | | |
|---|---|---|---|
| 3,021,654 | 2/1962 | Harris . | |
| 3,061,983 | 11/1962 | Irwin | 53/138.3 |
| 3,163,970 | 1/1965 | Paxton | 53/138.3 |
| 4,563,856 | 1/1986 | Kusters | 53/138.3 |
| 4,648,178 | 3/1987 | McGrath | 53/138.2 |
| 4,811,545 | 3/1989 | Oxman | 53/138.3 |

FOREIGN PATENT DOCUMENTS

| | | | |
|---|---|---|---|
| 0521552 | 2/1956 | Canada | 53/138.3 |
| 0571439 | 2/1957 | Canada | 53/138.3 |

*Primary Examiner*—John Sipos
*Assistant Examiner*—Ed Tolan
*Attorney, Agent, or Firm*—Cushman Darby & Cushman

[57] ABSTRACT

A binding machine which uses a binding piece belt which is a series of binding pieces each of which is a flat plate of elastic material having a first opening substantially at the center into which an object to be bound therewith is inserted, a second opening which is communicated with the first opening and extended to the outer periphery of the flat plate, and a pair of locking wings provided on both sides of the second opening, and the binding machine which operates to put the binding piece located at the top of the binding piece belt on the puckered mouth of a bag and bind the puckered mouth of the bag such a manner that the binding piece is substantially conical and the first opening engaged with the puckered mouth of the bag is at the top, the binding machine comprises a binding-piece feeding passageway and a binding piece holder. The binding-piece feeding passageway arranges the binding piece in a position that the binding piece is substantially conical, that the convex side thereof is the same direction as the opening of the bag and that the first opening engaged with the puckered mouth of the bag is at the top. The binding piece holder for maintaining the position of the binding piece when the binding piece is put on the puckered mouth of the bag.

5 Claims, 10 Drawing Sheets

BINDING MACHINE

BACKGROUND OF THE INVENTION

This invention relates to a binding machine which operates to close the mouth of a synthetic resin bag (or net bag) in which pieces of bread, candy or the like have been put.

A bag mouth binding machine has been disclosed by Examined Japanese Patent Publication No. Sho. 63-62416/1988 which uses a flat string of polyvinyl chloride with a thin iron wire as its core to close the mouth of a bag containing pieces of bread, candy or the like. The binding machine has a folding pawl which feeds the flat binding string, in which a core wire such as a metal wire has been buried, as much as a predetermined length, and cuts it and lays it over the mouth of the bag, and turns while catching the end of the flat binding string. More specifically, the binding machine is designed as follows: A flat frame having a bag mouth guide groove at the front end is made up of a pair of side walls, a driving main shaft is provided at the base end which is in alignment with the axial line of the bag mouth guide groove, and a string twisting intermittent gear having a power source releasing arcuate cam on its one side and a string twisting intermittent face gear are provided in front of the driving main shaft. In addition, in the binding machine, a pinion provided at the base end of an orthogonal spindle having a holding pawl at the top end is engaged with the string twisting intermittent face gear, a cam for a string winding arm is integrally provided behind the driving main shaft, a driven lever extended downwardly is swingably provided at the position to which the cam is intermittently turned, a rocking arm is pivotally mounted on the shaft of the driven lever which has a front end winding movable pawl at the front end and an after-motion regulating movable pawl at the middle. Furthermore, in the binding machine, a transmission gear having a resting arcuate portion formed by cutting it is engaged with a string feeding intermittent gear, the resting arcuate portion is so arranged as to slide on the power source releasing arcuate cam, and one of a pair of frictional wheels is mounted on the shaft of the transmission gear.

A binding piece for binding the mouth of synthetic resin bag, such as a bag of polyvinyl chloride, in such a manner that the mouth is puckered, has been disclosed, for instance, by U.S. Pat. Ser. No. 3,021,354. The binding piece has an opening in which the mouth of a bag to be bound is inserted, and a slit through which the puckered mouth of a bag is moved so as to be set in the opening, and prickles or protrusions extended from the edge of the opening towards the center of the latter.

The binding machine disclosed by Japanese Patent Application Publication No. 63-62416/1988 uses the binding string whose core wire is the metal wire as is described above. Hence, the person who has purchased the article wrapped with the bag thus bound, may hurt the fingers with the binding string depending on the way he handles it. In addition, in the case where the article in the bag is heavy, the binding force of the binding string may not be great enough to keep the mouth of the bag closed.

SUMMARY OF THE INVENTION

The present Applicant has proposed, under Japanese Patent Application No. Hei. 4-264263/1992, a binding piece for closing the mouth of a bag which is so designed that, when it is initially used, its binding force is great, and even when it is used again, the manual binding operation can be readily achieved with the initial binding force being maintained unchanged, and a binding method using the binding piece.

The binding method thus proposed comprises: a step in which a binding piece which is a flat plate of elastic material having a first opening substantially at the center into which an object to be bound therewith is inserted, a second opening which is communicated with the first opening and extended to the outer periphery of the flat plate, and a pair of locking wings provided on both sides of the second opening, is coupled to the object through the second opening; a step in which the locking wings are crosswise engaged with each other through the second opening, so that the first opening is closed being decreased in diameter while the flat plate is curved substantially conical with the first opening thus closed at the top; and a step in which the binding piece thus curved is fixed conical with the locking wings.

An object of this invention is to provide a binding machine for practicing the above-described method.

The foregoing object of the invention has been achieved by the provision of a binding machine which uses a binding piece belt which is a series of binding pieces each of which is a flat plate of elastic material having a first opening substantially at the center into which an object to be bound therewith is inserted, a second opening which is communicated with the first opening and extended to the outer periphery of the flat plate, and a pair of locking wings provided both sides of the second opening, and which operates to put the binding piece located at the top of the binding piece belt on the puckered mouth of a bag and bind the puckered mouth of the bag therewith, which machine includes:

(a) a slider assembly which is reciprocated in a binding-piece-belt feeding passageway to feed the binding piece to the front end of the binding-piece-belt feeding passageway; and (b) a binding-piece engaging mechanism which is provided at the front end of the binding-piece-belt feeding passageway, and includes a crosswise engaging arm which is rotatable, and a pair of jigs which are fixed. In the binding machine, the crosswise engaging arm is extended backwardly of the binding-piece-belt feeding passageway, and under the condition that the crosswise engaging arm is held at an initial position forming a predetermined angle of rotation, the pair of locking wings of the binding piece are inserted therein by the feeding operation of the slider assembly in such a manner that the locking wings cross the crosswise engaging arm through the second opening. The binding piece is put on the puckered mouth of a bag through the first opening. The jibs are set adjacent to the crosswise engaging arm and fixed in front of the crosswise engaging arm, and when the crosswise engaging arm is at the initial position, the jigs are located ahead of the crosswise engaging arm in the direction of rotation of the crosswise engaging arm. And, in binding the mount of the bag with the binding piece, the crosswise engaging arm is turned around the central axis of the binding-piece-belt feeding passageway from the initial position, so that one of the pair of locking wings of said binding piece, while being in contact with the corresponding one of the pair of jigs, is guided in such a manner that the one locking wing is crosswise engaged with the other locking which is fixedly supported by the other jig, whereby the binding piece is curved in such a manner that the binding piece is substantially conical and the first opening engaged with the puckered mouth of the bag is at the top.

Furthermore, the present invention provides a binding machine which uses a binding piece belt which is a series of binding pieces each of which is a flat plate of elastic material having a first opening substantially at the center into which an object to be bound therewith is inserted, a second opening which is communicated with the first opening and extended to the outer periphery of the flat plate, and a pair of locking wings provided on both sides of the second opening, and the binding machine which operates to put the binding piece located at the top of the binding piece belt on the puckered mouth of a bag and bind the puckered mouth of the bag such a manner that the binding piece is substantially conical and the first opening engaged with the puckered mouth of the bag is at the top, the binding machine comprising:

(a) a binding-piece feeding passageway for arranging the binding piece in a position where the binding piece is substantially conical and that the first opening engaged with the puckered mouth of the bag is at the top; and (b) a binding piece holder for maintaining the position of the binding piece when the binding piece is put on the puckered mouth of the bag.

The binding machine of the invention operates as follows: The slider assembly is moved forwardly, to feed the binding piece to the front end of the binding-piece belt feeding passageway, as a result of which the pair of locking wings of the binding piece are inserted in the crosswise engaging arm by the feeding operation of the slider assembly in such a manner that the locking wings cross the crosswise engaging arm through the second opening. In this operation, the binding piece is put on the puckered mouth of the bag through the first opening. Then, the crosswise engaging arm is turned, so that one of the pair of locking wings of the binding piece, while being in contact with the corresponding one of the pair of jigs, is guided in such a manner that the one locking wing is crosswise engaged with the other locking which is fixedly supported by the other jig. This cross engagement of the locking wings curves the binding piece in such a manner that the latter is substantially conical and the first opening engaged with the puckered mouth of the bag is held at the top.

According to the present invention, the binding piece is kept the position that the binding piece is substantially conical and that the first opening engaged with the puckered mouth of the bag is at the top when the binding piece is put on the puckered mouth of the bag. Therefore, deformation of the locking wings of the binding piece can be prevented even though the reactive force from the puckered mouth of the bag. Accordingly, the binding machine of the invention can stably bind the puckered mouth of the bag with the binding piece which is substantially conical with the convex side thereof being the same direction as the opening of the bag. As a result, the binding piece has the large binding force. If the bag which is bound by the binding machine is hung upside down, no content falls down by its weight from the mouth of the bag.

DETAILED DESCRIPTION OF THE PREFERRED EMBODIMENTS

Outline of the Binding Machine

Figure 1:
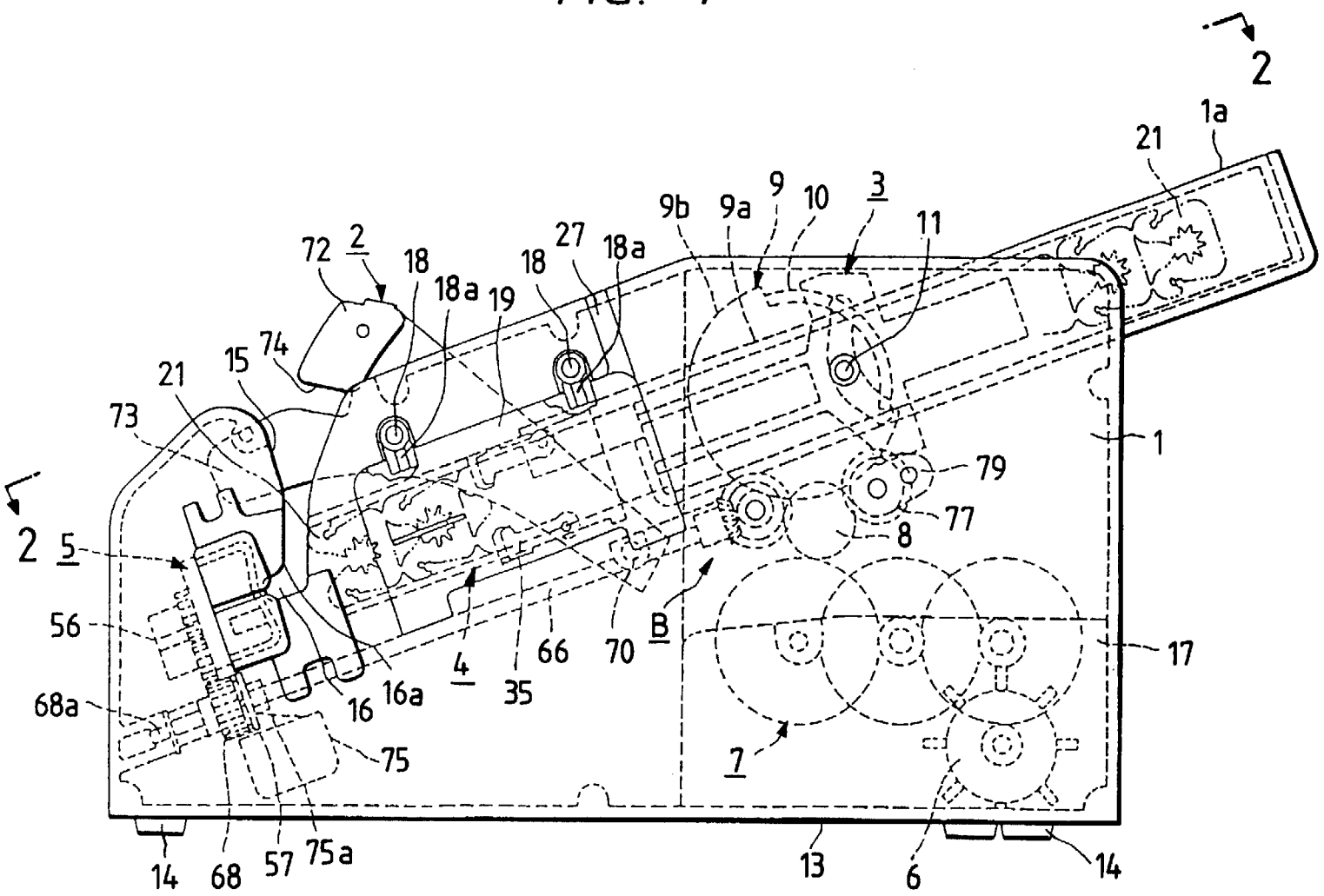
FIG. 1 is a right side view of a binding machine according to the invention.
Figure 2:
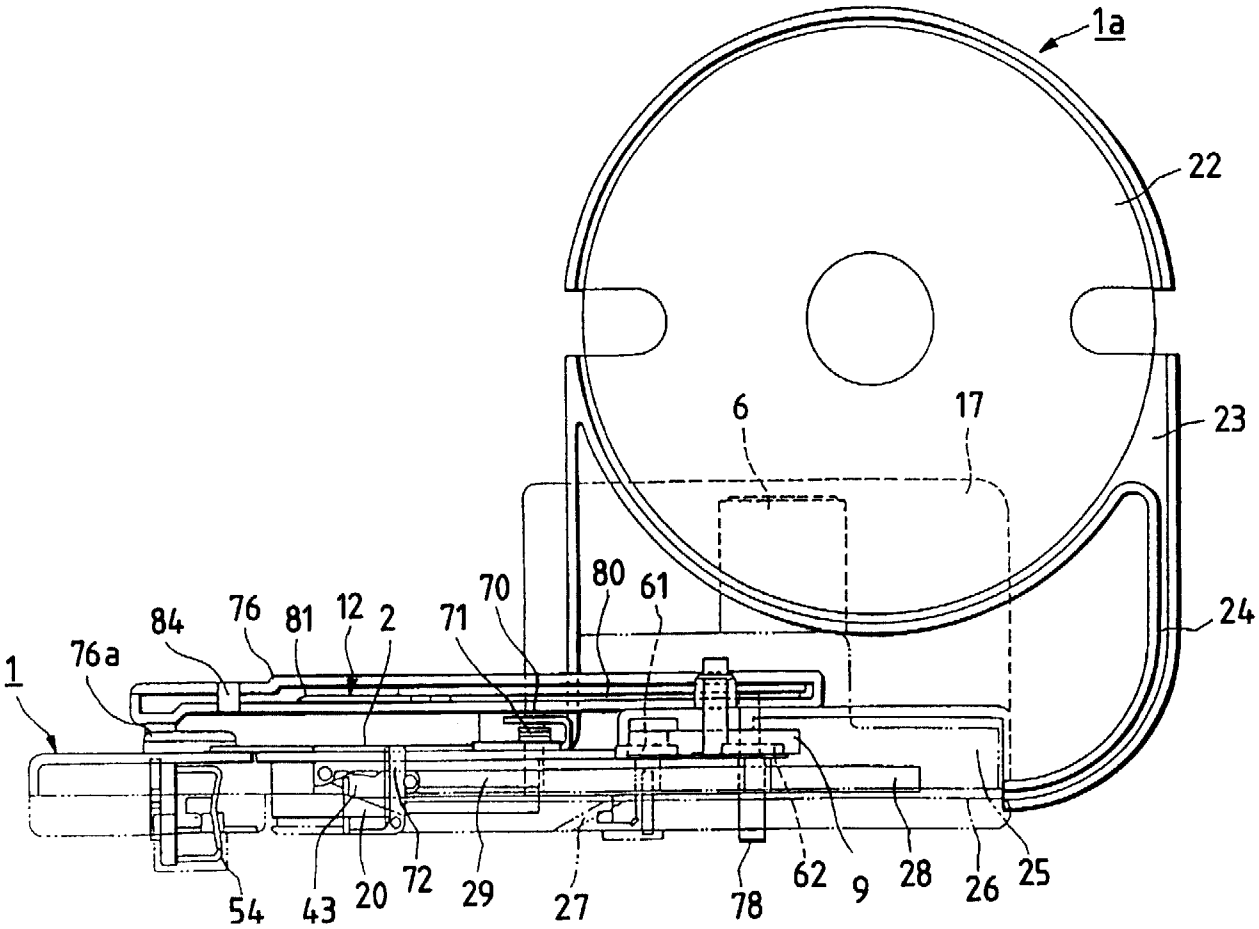
FIG. 2 is a view taken in the direction of the arrows substantially along line 2—2 in FIG. 1.

As shown in FIGS. 1 and 2, a binding machine according to the invention uses a series of binding pieces 21 (hereinafter referred to as "a binding piece belt", when applicable). Each of the binding pieces 21 is a flat plate of elastic synthetic resin having a star-shaped opening (or a first opening) 21*a* substantially at the center in which an object to be bound is set, a second opening 21*c* which is communicated with the star-shaped opening 21*a* and extended to the outer periphery of the flat plate; and a pair of locking wings 21*d* provided both sides of the second opening 21*c* (see FIG. 14). The binding machine operates to put the binding piece 21 on the puckered mouth of a bag which is located at the top of the binding piece belt, and bind it.

As shown in FIG. 1, the binding machine comprises as functional means: a binding machine body 1 which is pentagonal, substantially trapezoid, as viewed from side; a binding piece magazine 1*a* mounted on the rear end portion of the binding machine body 1 in such a manner that it is inclined forwardly; a trigger 2 pivotally mounted on the binding machine body 1; a slider assembly 3 extended in the rear-to-front direction of the binding machine body 1 in such a manner that it is inclined forwardly; a binding piece holder 4 fitted in the front of the slider assembly 3 in such a manner that it is coaxial with the slider assembly 3; pawls 35 for sliding the slider assembly 3 and the binding piece holder 4 as one unit or relative to each other; a binding-piece engaging mechanism 5 provided in the front of the binding machine body 1, more specifically at the front end of a binding-piece-belt feeding path; an electric motor 6 provided below the rear of the binding machine body 1; a reduction gear unit 7 driven by the output shaft of the electric motor 6; a main gear assembly 9 with an intermittent gear 10 which is driven by the output gear 8 of the reduction gear unit 7; a power transmitting mechanism B for coupling the intermittent gear 10 of the main gear assembly 9 to the binding-piece engaging mechanism 5; and a binding-piece feeding pawl and cutter assembly 43 provided at the front end of the slider assembly 3 (see FIG. 2). A bag mouth cutting mechanism 12, which is detachably mounted on the binding machine body 1 and coupled to the intermittent gear 10, is provided on the left of the binding machine body 1.

Now, the aforementioned functional means will be described in more detail.

Binding Machine Body

The binding machine body 1 has a plurality of fixing legs 14 on the front and rear end portions of the bottom 13. Those fixing legs 14 are set, for instance, on a horizontal work stand. The binding machine may be held vertically with the fixing legs set mounted on a vertical plane. In this case, as shown in FIG. 1, the left part of the binding machine would be disposed above right part of the binding machine.

The binding machine body 1 has a puckering groove 15 near the front end which is extended downwardly from the upper end of the binding machine body 1 in such a manner that its width is smaller downwards, so as to pucker the mouth of a bag. The lower end portion of the puckering groove 15 is extended forwardly from the central axis of the puckering groove 15, thus forming a disengagement preventing recess 16 which is rectangular. When the operator (worker), holding a bag containing candy or the like with his hands, moves it down the puckering groove 15 to the bottom, then the mouth of the bag is guided into the disengagement preventing recess 16 owing to the configuration of the puckering groove 15. In cutting the bag with the blade-shaped cutter 81 of the bag mouth cutting mechanism 12, an upward force is applied to the bag; however, the mouth of the bag will never go up the puckering groove being blocked by the upper wall 16*a* of the disengagement preventing recess 16.

A power unit accommodating section 17 accommodating the electric motor 6 and the reduction gear unit 7 is provided below the rear of the binding machine body 1, in such a manner that it protrudes from the left side of the binding machine 1.

As shown in FIG. 2, a ceiling wall 25 extends forwardly from the rear end of the binding machine body 1. More specifically, the ceiling wall extends to the left of the binding machine body 1 from the rear of the latter 1. In addition, a binding-piece loading opening 26, which is opened upwardly, is provided along the central axis of the binding machine body. The binding-piece loading opening 26 has an inclined passageway 27 which is bent to the right of the binding machine body 1. The inclined passageway 27 is communicated with a binding-piece supplying passageway 24 which extends from the binding-piece magazine 1*a* through the disengagement preventing recess 16 of the puckering groove 15.

As shown in FIG. 1, a door 19 is provided between the puckering groove 15 and the power unit accommodating section 17. More specifically, the door 19 is provided in the right side of the binding machine body 1 which defines the binding-piece feeding passageway, in such a manner that it is vertically opened with two shafts (not shown) which are extended in the front-to-rear direction of the binding machine body 1. Two pawls 18*a*, which are pivotable about two shafts 18, are provided on the upper edge of the door 19. The door 19, when closed, is latched with the pawls 18*a*. A rectangular-triangle-shaped check pawl 20 (see FIG. 2) is provided on the inner surface of the door 19 in such a manner that its front end is perpendicular to the front-to-rear axis of the binding machine body 1. The front end of the check pawl 20 abuts against the rear end of the binding piece 21 which is located at the top of the binding piece belt, to prevent the backward movement of the binding piece 21.

Binding Piece Magazine

The binding piece magazine 1*a* shown in FIG. 2 is like a plate. The binding piece magazine la is detachably mounted on the rear portion of the binding machine body 1 in such a manner that it protrudes to the left of the binding machine 1. The binding piece magazine 1*a* comprises: a reel mounting section 23 for mounting a reel 22 on which a binding piece belt is wound; and a binding-piece supplying passageway 24 small in width which is extended from the rear end of the reel mounting section 23 and curved towards the rear end of the binding machine body 1. The binding-piece supplying passageway 24 is communicated with the binding-piece loading opening 26. The binding piece belt can be readily loaded in the binding piece magazine 1*a* by setting the reel, on which the binding piece belt has been wound, in the reel mounting section from above with its lead-out laid in the binding-piece supplying passageway 24 from above.

Trigger

The trigger 2 is provided on the left side of the binding machine body 1 substantially contacting the door 19. More specifically, the trigger 2 is swingably mounted on a shaft 70so that it swings back and forth in the binding machine body 1. A torsion coil spring 71 is wound on the shaft 70 to urge the trigger 2 clockwise in FIG. 1. Before the bag mouth is puckered, a stopper (not shown) holds the trigger 2 at the position shown in FIG. 2.

A U-shaped upper bag mouth receiving member 72 is provided at the front end (the left end in FIG. 2) of the trigger 2 which is disposed on the right side of the binding machine body 1. A lower bag mouth receiving member 73 is provided below the upper bag mouth receiving member 72 and only on the left side of the binding machine body 1 in such a manner that it covers the upper opening of the puckering groove 15 from the left side of the binding machine body 1. A substantially rectangular groove 74 is provided between the upper bag mouth receiving member 72 and the lower bag mouth receiving member 73. When the operator pushes the trigger 2 to the lower end position, the groove 74 is lapped over the disengagement preventing recess 16 of the puckering groove 15, thus forming a rectangular opening in which the bag mouth is set in its entirety. Thus, the locking wings 21*d* of the binding piece 21 are placed smoothly around the puckered bag mouth.

Furthermore, in the binding machine body 1, a limit switch type trigger switch 75 is provided below the pawl clutch 57 of the power transmitting mechanism B. The trigger switch 75 is to activate an electrical circuit (not shown) to rotate the electric motor as much as one binding cycle. When the lower end of the lower bag mouth receiving member 73 of the trigger 2 pushes down the actuator 75*a* of the trigger switch 75, the latter 75 is closed to activate the electrical circuit.

Slider Assembly

Figure 3:
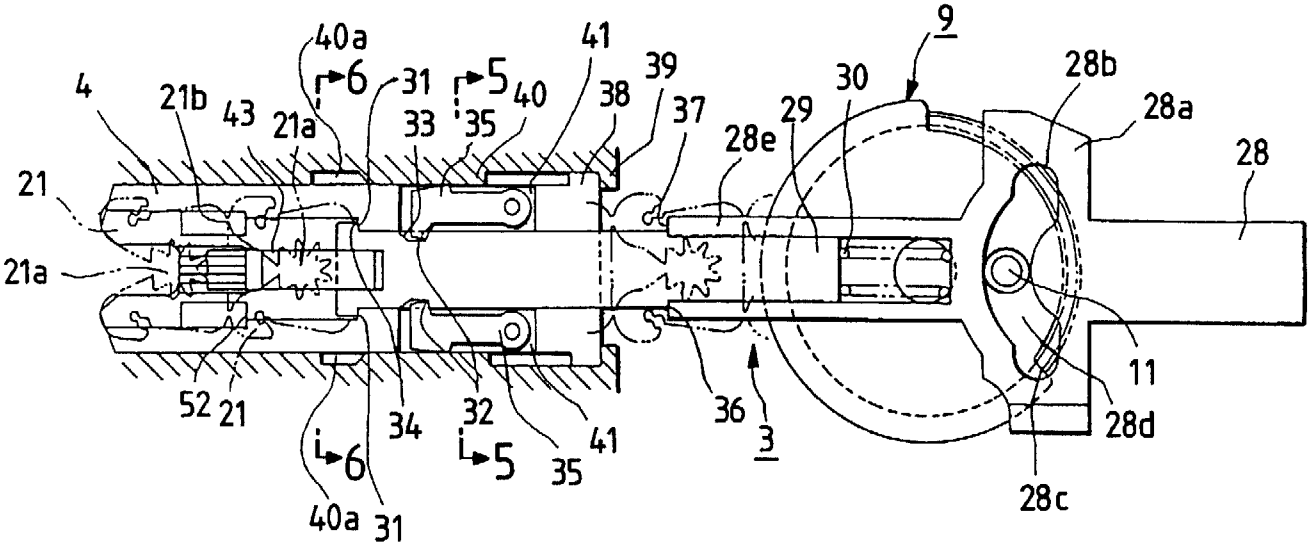
FIGS. 3 and 4 are a right side view and a plan view, respectively, showing the arrangement of a slider assembly, a binding piece holder, and a feeding pawl and cutter assembly in an operating step that a binding piece is going to be fed.

As shown in FIG. 3, the slider assembly 3 is provided in the binding-piece-belt feeding passageway in the binding machine body 1. The slider assembly 3 is reciprocated in the binding-piece-belt feeding passageway, to feed the binding piece 21 to the front end of the binding-piece-belt feeding passageway. The slider assembly 3 comprises: a cross-shaped first slider 28 which .is driven by an eccentric pin 11 which serves as a cam; and a straight-bar-shaped second slider 29 which is in alignment with the first slider 28 and is movable along the binding-piece-belt feeding passageway with the aid of a compression coil spring 30. The slider assembly 3 feeds the binding piece belt in the direction of the force which is against the elastic force of the compression coil spring.

The first slider 28 has a lateral bar 28*a*, in which a cam groove 28*d* is formed. The cam groove 28*d* is substantially arcuate and has a pair of dead ends 28*b* and 28*c* at both ends. The aforementioned eccentric pin 11 is loosely fitted in the cam groove 28*d*. The front end portion 28*e* of the first slider 28 is fork-shaped, having two legs. The first slider 28 is reciprocated along the binding-piece belt feeding passageway by the rotational motion of the eccentric pin 11 which is due to the rotation of the main gear assembly 9.

Figure 5:
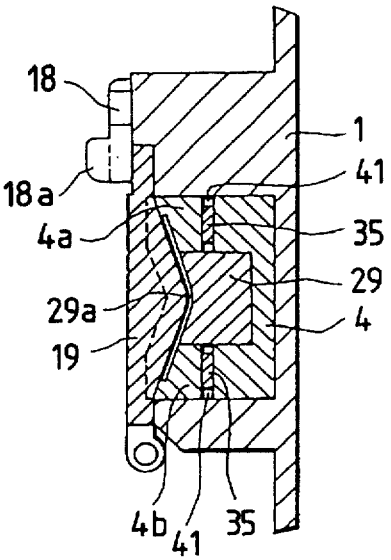
FIG. 5 is a sectional view taken along line 5—5 in FIG. 3.
Figure 7:
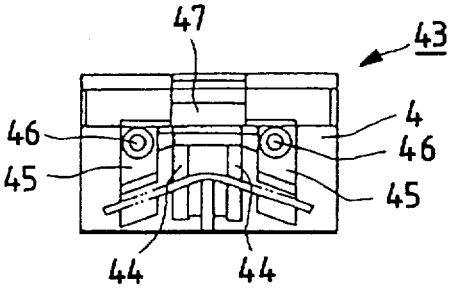
FIG. 7 is a front view showing the arrangement of the slider assembly, the binding piece holder, and the feeding pawl and cutter assembly in the above-described operating step.

As shown in FIG. 5, the second slider 29 has a right side 29*a* which is substantially L-shaped in section, being bent inwardly. The right side 29*a* of the second slider 29 cooperates with the inner surface of the door 19 in such a manner that the right side 29*a* substantially L-shaped in section locates the star-shaped opening 21*a* of the binding piece 21 at the center to positively feed the binding piece 21 toward the puckering groove 15. The second slider 29 has a pair of slider-side first locking portions 31 at the front end, which have shoulders which face rearwardly. The second slider 29 further has a pair of slider-side second locking portions 32 near the pair of slider-side first locking portions 31. The slide-side first locking portions 31 are engaged with and released from a pair of holder-side first locking portions 34, respectively, which are formed substantially at the centers of the inner surfaces of the upper and lower sides of the binding piece holder 4 in such a manner that they are extended inwardly, or towards each other, thus having shoulders which face forwardly. The slider-side second locking portions 32 are cuts formed in the second slider 29, each of which has a sloped surface 33 which is inclined forwardly in the direction of the axis of the second slider 29. The slider-side second locking portions 32 are engaged with and released from a pair of pawls 35 which are swingably provided behind the binding piece holder 4.

The second slider 29 has a pair of slider-side third locking portions 36 which are located somewhat toward the rear end from the middle of the second slider 29. The slider-side third locking portions 36 have shoulders which face rearwardly, so that they are engaged with the front end 37 of the first slider 28.

In a binding-piece feeding operation, the second slider 29 pushes the binding piece 21, which is located at the top of the binding piece belt, to the front end of the binding-piece-belt feeding passageway with the aid of the binding-piece feeding pawl and cutter assembly 43 (described later). When a load larger than a predetermined value is applied to the second slider 29, the compression coil spring 30 is energized to decrease the length of the slider assembly 3, thus protecting the loaded components or binding machine itself from damage.

Binding-Piece Feeding Pawl and Cutter Assembly

Figure 4:
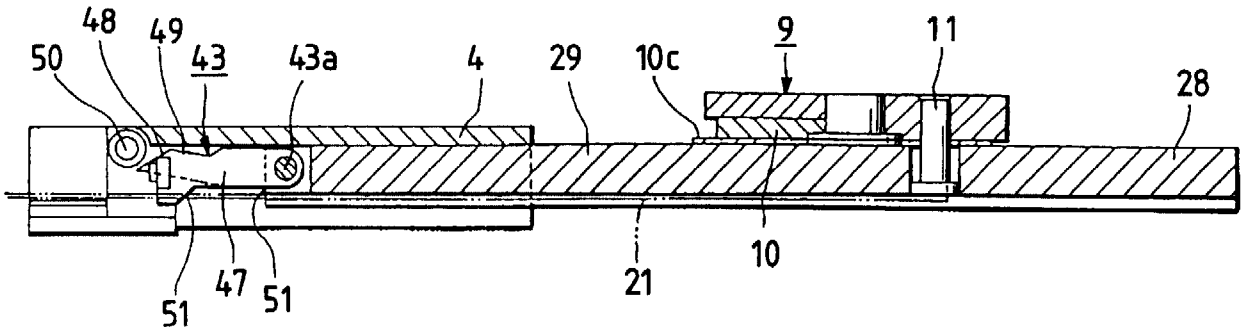

As shown in FIGS. 3 and 4, the binding-piece feeding pawl and cutter assembly 4.3 is provided in the binding piece holder 4, in such a manner that it is extended forwardly from the front end of the second slider 29 along the axis of the latter 29, and is pivotable about a shaft 43*a*.

Figure 9:
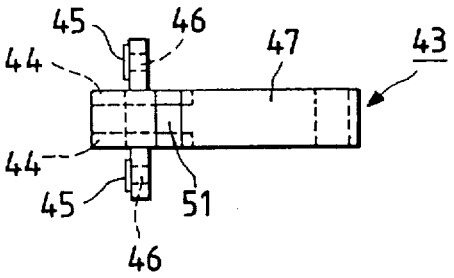
Figure 10:
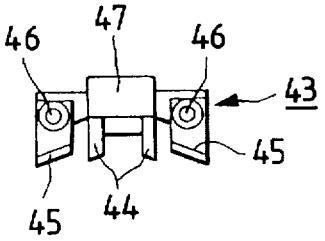

As shown in FIGS. 9 and 10, the body 47 of the binding-piece feeding pawl and cutter assembly 43 has right and left feeding pawls 44. The feeding pawls 44 are inserted into the star-shaped opening 21*a* of the binding piece 21 in such a manner that they are engaged with the edge of the star-shaped opening 21*a*.

The body 47 has a pair of right and left blade-shaped cutters 45 which are secured thereto with screws 46. The blade-shaped cutters 45 are located somewhat behind the front end of the body 47 and outside the feeding pawls 44. As shown in FIG. 10, each of the cutters 45 has a sloped edge which is inclined inwardly and rearwardly. The feeding pawls 44 have sloped front ends, which are located in front of the sloped edges of the cutters 45.

Figure 8:
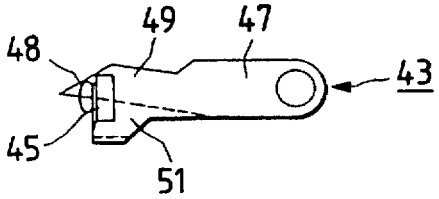
FIGS. 8, 9 and 10 are a plan view, a right side view, and a front view, respectively, showing the feeding pawl and cutter assembly.
Figure 6:
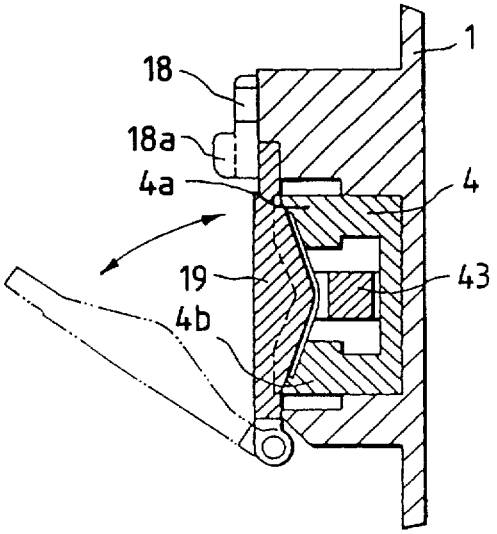
FIG. 6 is a sectional view taken along line 6—6 in FIG. 3.

As shown in FIGS. 4 and 8, the left side of the body 47 of the binding-piece feeding pawl and cutter assembly 43 has a sloped guide surface 48 at the front end. The rear end of the guide surface 48 merges with an abutting surface 49 which is sloped gently in the direction opposite to the direction of inclination of the guide surface 48.

Figure 11:
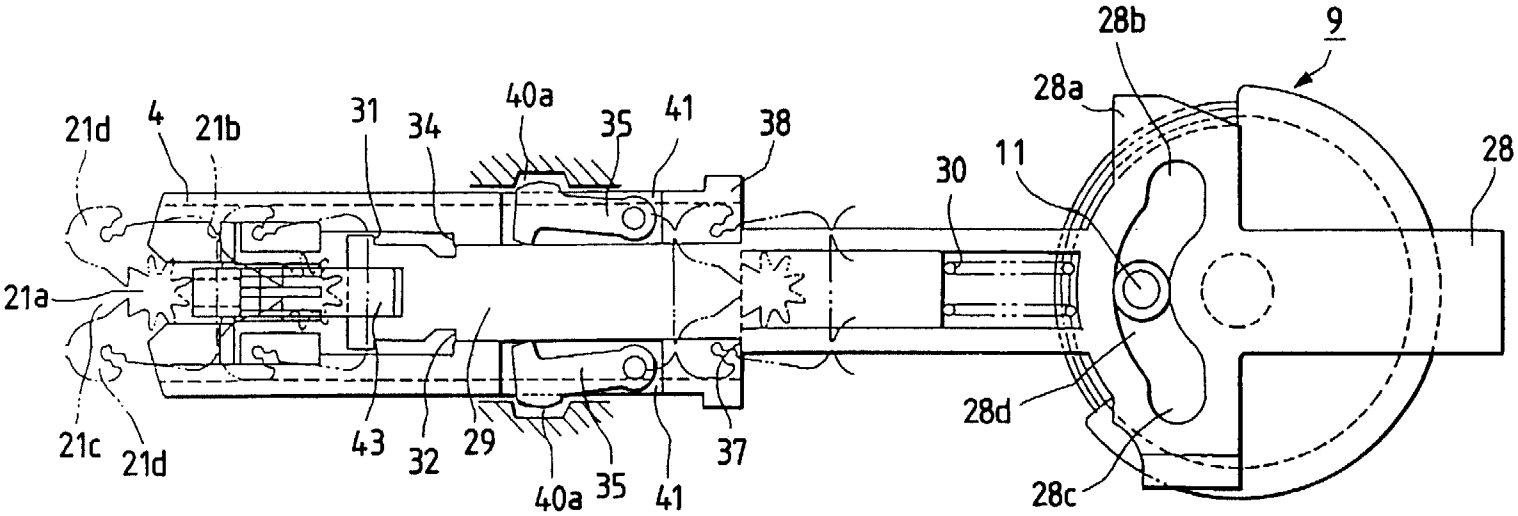
FIGS. 11, 12 and 13 are a right side view, a plan view, and a front view, respectively, showing the arrangement of the slider assembly, the binding piece holder, and the feeding pawl and cutter assembly in an operating step that the binding piece has been fed.
Figure 12:
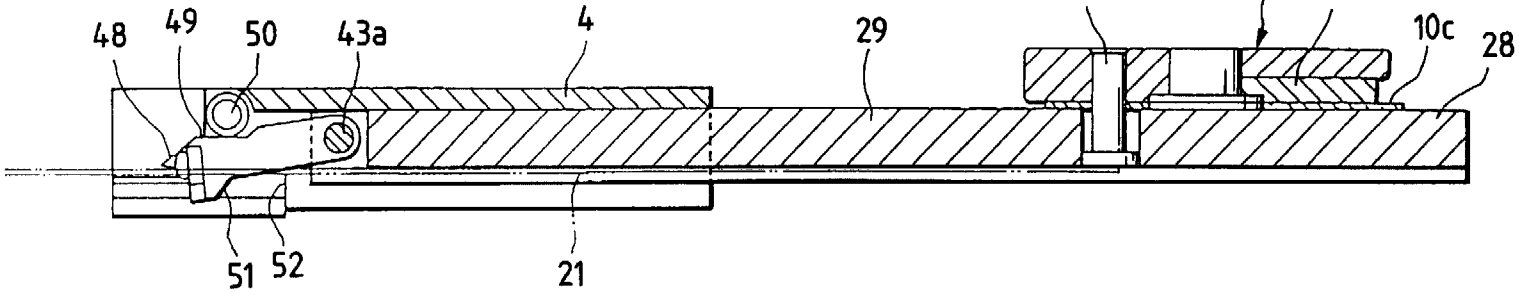
Figure 13:
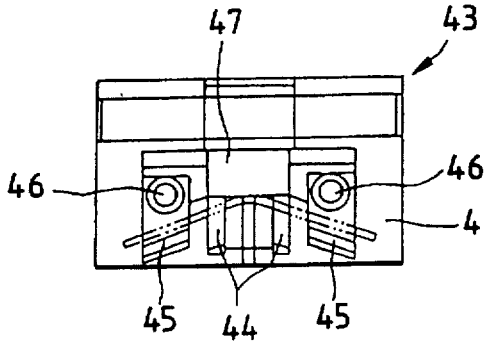

In addition, a boss 50 is provided on the left side of the binding piece holder 4 near the front end. The boss 50 is adapted to engage with or disengage from the guide surface 48 and the abutting surface 49 of the body 47 of the binding-piece feeding pawl and cutter assembly 43. As shown in FIGS. 3 and 11, when, in the case where the slider assembly 3 and the binding piece holder 4 are moved forwardly as one unit, the holder-side second locking portions 38 engages with a body-side second locking portion 40, and the binding piece holder 4 is stopped while the slider assembly 3 is allowed to further move forwardly. In this case, the guide surface 48 and the abutting surface 49 of the binding-piece feeding pawl and cutter assembly 43 abut the boss 50 successively, thus turning the binding-piece feeding pawl and cutter assembly 43 counterclockwise in FIG. 12. As a result, the pair of cutters 45 of the binding-piece feeding pawl and cutter assembly 43 cut the coupling portions 21*b* between the binding piece 21 at the top of the binding piece belt and the following binding piece 21.

The front end portion of the right side of the body 47 of the binding-piece feeding pawl and cutter assembly 43 has a sloped surface 51 which is inclined rearwardly to the right. More specifically, the sloped surface 51 is positioned behind the cutter 45. When the second slider 29 is retracted, the sloped surface 51 is caused to slide on the holder-side second locking portion 52 of the binding piece holder 4, so that the binding-piece feeding pawl and cutter assembly 43 is turned to the left (clockwise in FIG. 12), and therefore the cutters 45 are moved away from the binding piece belt.

Binding Piece Holder

As shown in FIGS. 3 and 5, the binding piece holder 4 is an elongated member substantially. U-shaped in section, and is provided outside the second slider 29; more specifically, it is slidably engaged with the front portion of the second slider 29. The left surfaces of the upper and lower portions 4*a* and 4*b* of the binding piece holder 4 are sloped in conformance with the left surface of the second slider 29 which is substantially L-shaped in section as shown in FIG. 5 so that the binding piece 21 is folded in such a manner that it is substantially L-shaped in section with the star-shaped opening 21*a* at the top.

The binding piece holder 4 is so arranged as to be freely movable in the direction of the axis of the binding-piece-belt feeding passageway with respect to the binding machine body 1. The binding piece holder 4 has a pair of holder-side second locking portions 38 which face forwardly. The holder-side second locking portions 38 are engaged with and disengaged from a pair of body-side first locking portions 39 of the binding machine body 1 which have shoulders faced forwardly, and the body-side second locking portions 40 which have shoulders faced rearwardly.

The binding piece holder 4 has a pair of side recesses 41 in the upper and lower portions thereof near and in front of the holder-side second locking portions 38. The side recesses 41 accommodate the aforementioned pair of pawls 35. The binding piece holder has the holder-side first locking portions 34 in front of the side recesses 41 provided with shoulders which face forwardly. The binding piece holder 4 further includes holder-side third locking portions 42, which are engaged with and disengaged from the slider-side first locking portions 31 of the second slider 29.

Pawls

The pawls 35 are locking means which are provided between the slider assembly 3 and the binding piece holder 4, and slidably control the slider assembly 3 and the binding piece holder 4 as one unit or relative to each other. With the outsides of the pawls 35 being in sliding contact with the inner surfaces of the binding machine body 1, the pawls 35 are engaged with the slider-side second locking portion 32 to lock the slider assembly 3 and the binding piece holder 4 as one unit until the binding piece 21 at the top of the binding piece belt is cut off by the binding-piece feeding pawl and cutter assembly 43. Until the binding piece 21 cut off the binding piece belt by the binding-piece feeding pawl and cutter assembly 43 is put on the puckered mouth of the bag, the pawls 35 are retracted into the recesses 40a formed in the inner surfaces of the binding machine body 1, so that the slider assembly 3 is released from the binding piece holder 4. As a result, the binding piece holder 4 is stopped while holding the binding piece 21, which is at the top of the binding piece belt, folded in a substantially L-shape. In this operation, the pawls 35 allow the slider assembly 3 to move together with the binding-piece feeding pawl and cutter assembly 43 forwardly of the binding-piece feeding passageway so as to be put around the puckered mouth of the bag.

Binding-Piece Engaging mechanism

Figure 14:
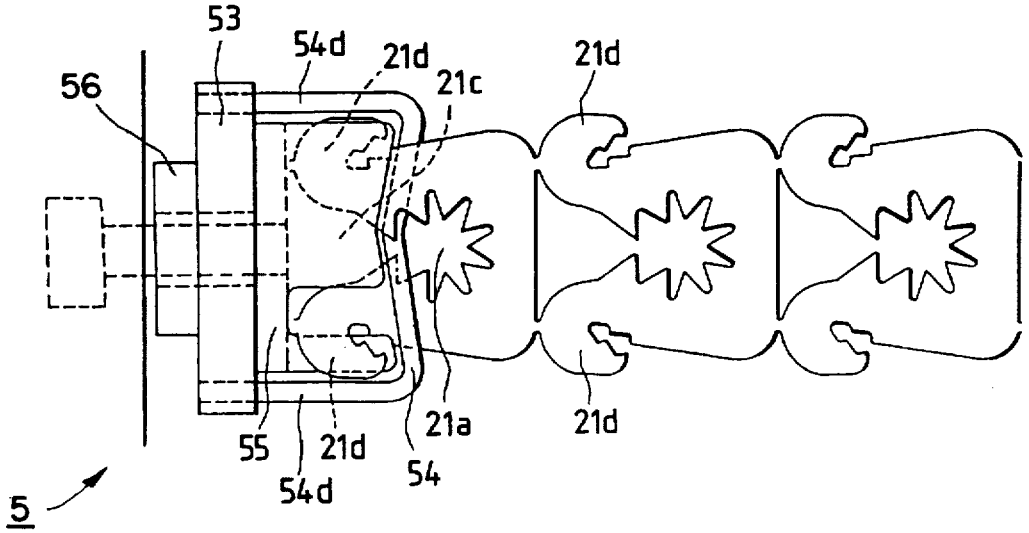
FIGS. 14 and 15 are a right side view and a rear view, respectively, showing a binding-piece engaging mechanism.

As shown in FIG. 14, in the binding machine body 1, the binding-piece engaging mechanism is so positioned as to confront the binding piece 21, located at the top of the binding piece belt, through the disengagement preventing recess 16 of the puckering groove 15.

The binding-piece engaging mechanism 5 comprises: a disk 53 of synthetic resin; a crosswise engaging arm 54 extended backwardly from the disk 53; a jig 55 of synthetic resin which is fixedly secured to the binding machine body 1 and is extended rearwardly from the disk 53 toward the rear end portion of the crosswise engaging arm 54; and a driven gear 56 integral with the front end face of the disk 53.

As shown in FIE 15 the crosswise engaging arm 54 comprises a portion which is substantially S-shaped as viewed from behind, and two post portions 54 extended forwardly form the upper and lower ends of the S-shaped portion. The post portions 54 are embedded in the disk 53. The substantially S-shaped portion of the crosswise engaging arm 54 is made up of a middle portion 54*c* which is curved, and first and second arm portions 54*a* and 54*b* extended from both ends of the middle portion 54*c*. As shown in FIG. 14, the crosswise engaging arm 54 is held at the predetermined position after being turned. When, under this condition, the second slider 29 of the slider assembly 3 is moved forwardly, then the two side wings 21*d* of the binding piece 21, which is located at the top of the binding piece belt, are engaged with the crosswise engaging arm 54 in such a manner that the first and second arm portions 54*a* and 54*b* of the crosswise engaging arm 54 meet the two side wings from right and left, or from both sides (with respect to the middle portion 54*c*).

Figure 15:
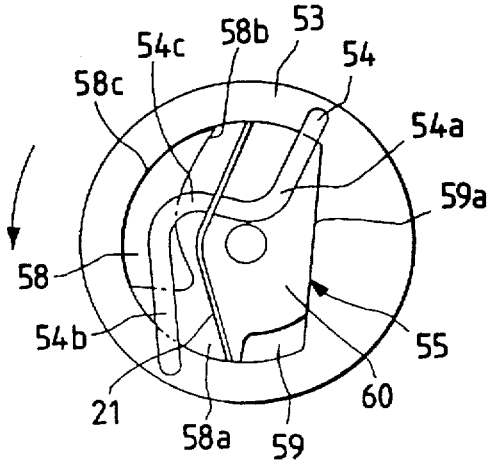
Figure 16:
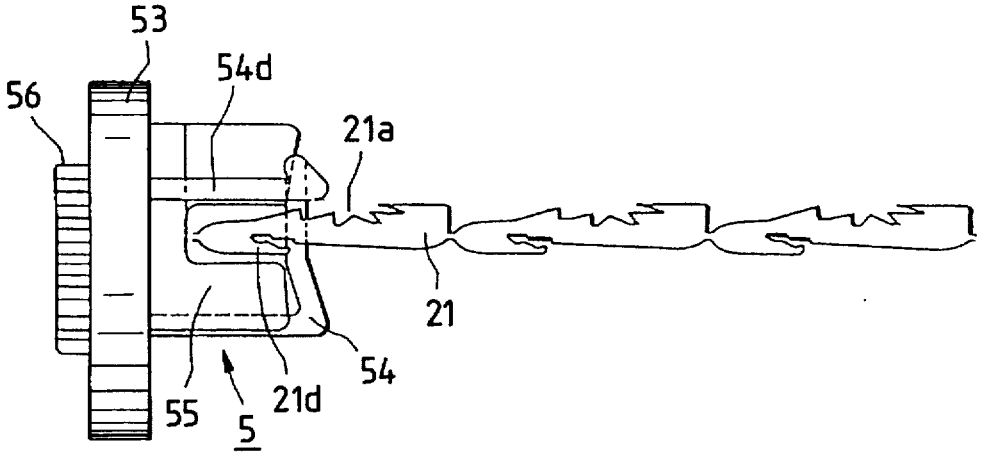
FIG. 16 is a right side view of the binding-piece engaging mechanism which has been turned through 90° from its position shown in FIG. 15.

As shown in FIG. 15, in the binding-piece engaging mechanism 5, the configuration of the jig 55, when viewed from behind, is defined by an arc 58*c* and a chord 59*a*. The jig 55 comprises: a first pawl portion 58, and a second pawl portion 59. The first pawl portion 58 extends rearwardly from a part of the arc 58*c* confronted with the chord 59*a* and covers almost all the triangular opening 21*c* between the side wings 21*d* of the binding piece 21. The second pawl portion 59 is formed where the arc 58*c* meets the chord 59*a* in such a manner that its protrudes rearwardly through an arcuate opening 58*a*, so as to receive the other side wing 21*d* of the binding piece 21 from behind. The jig includes a space 60 in addition to the first and second pawl portions 58 and 59.

As shown in FIG. 15 when the crosswise engaging arm 54 is turned counterclockwise, the first and second arm portions 54*a* and 54*b* engage with the two side wings 21*d* of the binding piece 21, thus twisting the side wings 21*d* counterclockwise in FIG. 15. When the first arm portion 54*a* of the crosswise engaging arm 54 turning counterclockwise goes past the first pawl portion 58 along the inner surface of the latter, the one side wing 21d of the binding piece 21 engaged with the first arm portion 54*a* is twisted towards the opening 58*a* while being guided by the inner surface 58*b* of the first pawl portion 58. Hence, when the one side wing 21*d* as shown in FIG. 14 is turned through about 360°, it is crosswise engaged with the other side wing 21*d* which is twisted counterclockwise by the second arm portion 54*b* and the second pawl portion 59.

Figure 17:
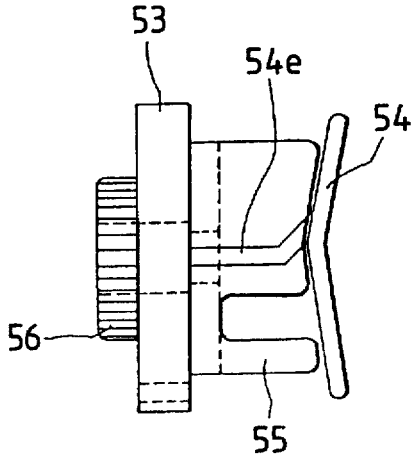
FIGS. 17 and 18 are a right side view and a rear view, respectively, showing one modification of the binding-piece engaging mechanism.
Figure 18:
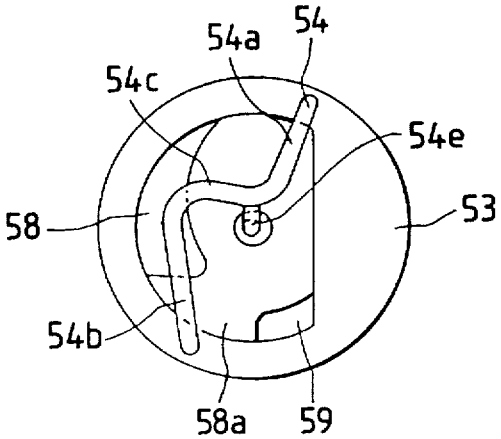

FIGS. 17 and 18 show one modification of the binding-piece engaging mechanism. In the modification, the middle portion 54*c* of the crosswise engaging arm 54 is supported by only one post portion 54*e*. The crosswise engaging arm 54 may be a linear one as long as the two side wings 21*d* of the binding piece can be set therein in such a manner that they cross the crosswise engaging arm 54 through the second opening 21*c*.

Electric Motor

The electric motor 6 is an ordinary DC motor.

Main Gear Assembly

Figure 19:
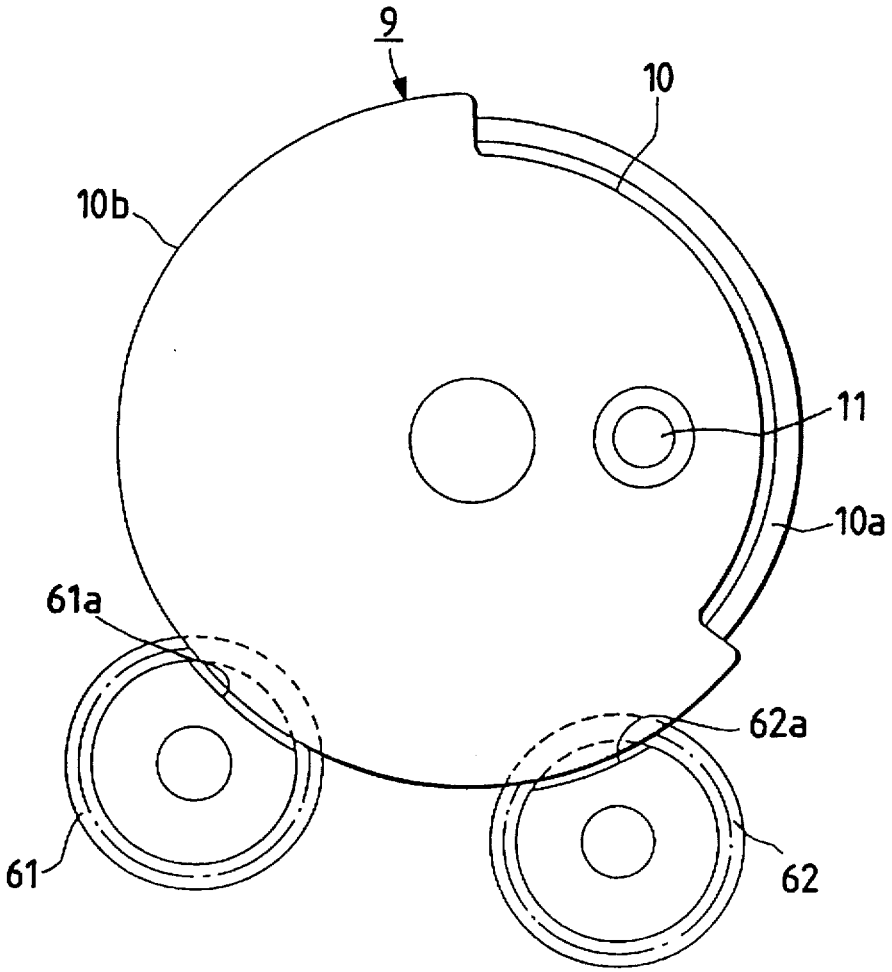
FIG. 19 is a side view showing the engagement of a main gear assembly and two transmission gears.
Figure 20:
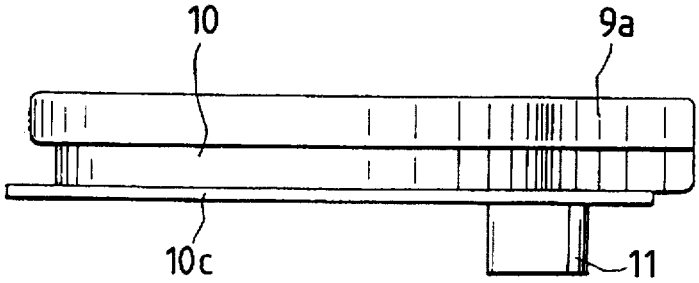
FIG. 20 is a plan view of the main gear assembly.

The main gear assembly 9, shown in FIGS. 19 and 20, is substantially equivalent to a conventional one. The main gear assembly 9 comprises: a main gear 9*a* having teeth in its entire outer periphery; an intermittent gear 10 which is integrally provided on the side of the main gear 9*a*, and has teeth 10*a* in a predetermined range of its outer periphery; and a control board 10*c* which is provided on the side of the intermittent gear 10 in such a manner that it is integral with the latter 10, and has an arcuate flange 10*b* in correspondence to the part of the intermittent gear 10 where no teeth 10*a* are formed.

In the main gear assembly 9, the main gear 9*a* is kept engaged with the output gear 8 of the reduction gear unit 7 at all times. As the output gear 8 rotates, the main gear 9*a* is turned counterclockwise in FIGS. 1 and 19, and the slider assembly 3 is reciprocated along its axis by the eccentric motion of the eccentric pin 11 which is positioned off the center of the main gear assembly 9.

Transmission gears 61 and 62 are provided on the circular periphery of the main gear assembly 9. The transmission gear 61 is engageable with the teeth 10*a* of the intermittent gear 10, and acts to transmit torque to the binding-piece engaging mechanism 5. The transmission gear 62 is to transmit torque to the bag mouth cutting mechanism 12. The transmission gears 61 and 62 have teeth in their entire outer peripheries which are engaged with the teeth 10*a*, and have cuts 61*a* and 62*a* so that they are maintained fixed at a predetermined angular position being engaged with the flange 10*b* of the control board 10*c*. Those cuts 61*a* and 62*a* will not adversely affect the engagement of the transmission gears 61 and 62 with the teeth 10*a* of the intermittent gear 10.

When the main gear assembly 9 is turned counterclockwise in FIGS. 1 and 19 by the output gear 8 of the reduction gear unit 7, initially the part of the intermittent gear 10 where no teeth 10*a* are provided is confronted with the transmission gear 61, and therefore the latter 61 is not turned. In addition, in this case, the flange 10*b* of the control board 10*c* is engaged with the cut 61*a* of the transmission gear 61, and therefore the latter 61 is held fixed at the predetermined angular position. Accordingly, the binding-piece engaging mechanism 5 is held fixed at a predetermined angular position. As the main gear assembly 9 is further turned, the cut 61*a* is disengaged from the flange 10*c*, and the teeth 10*a* of the intermittent gear 10 are engaged with the transmission gear 61. As a result, the latter 61 is turned from the predetermined angular position, and at the same time the binding-piece engaging mechanism 5 is turned from the predetermined angular position. As is apparent from FIG. 19, the transmission gear 62 stopped at the predetermined angular position is engaged with the teeth 10*a* of the intermittent gear 10 later than the transmission gear 61, to activate the bag mouth cutting mechanism 12. The number of teeth 10*a* of the intermittent gear 10 is equal to the number of teeth of each of the transmission gears 61 and 62. Hence, when the main gear assembly 9 makes one revolution, each of the transmission gears 61 and 62 makes one revolution; in other words, they are returned to their predetermined angular positions and stopped thereat every time.

Thus, after the operator (or worker) pushes down the mouth of the bag to the disengagement preventing recess 16 of the puckering groove 15 thereby to depress the trigger 2, the main gear assembly 9 determines the sequence and timing of the operations of the slider assembly 3, the binding piece holder 4, the binding-piece engaging mechanism 5 and the bag mouth cutting mechanism 12.

Power Transmitting Mechanism

Figure 21:
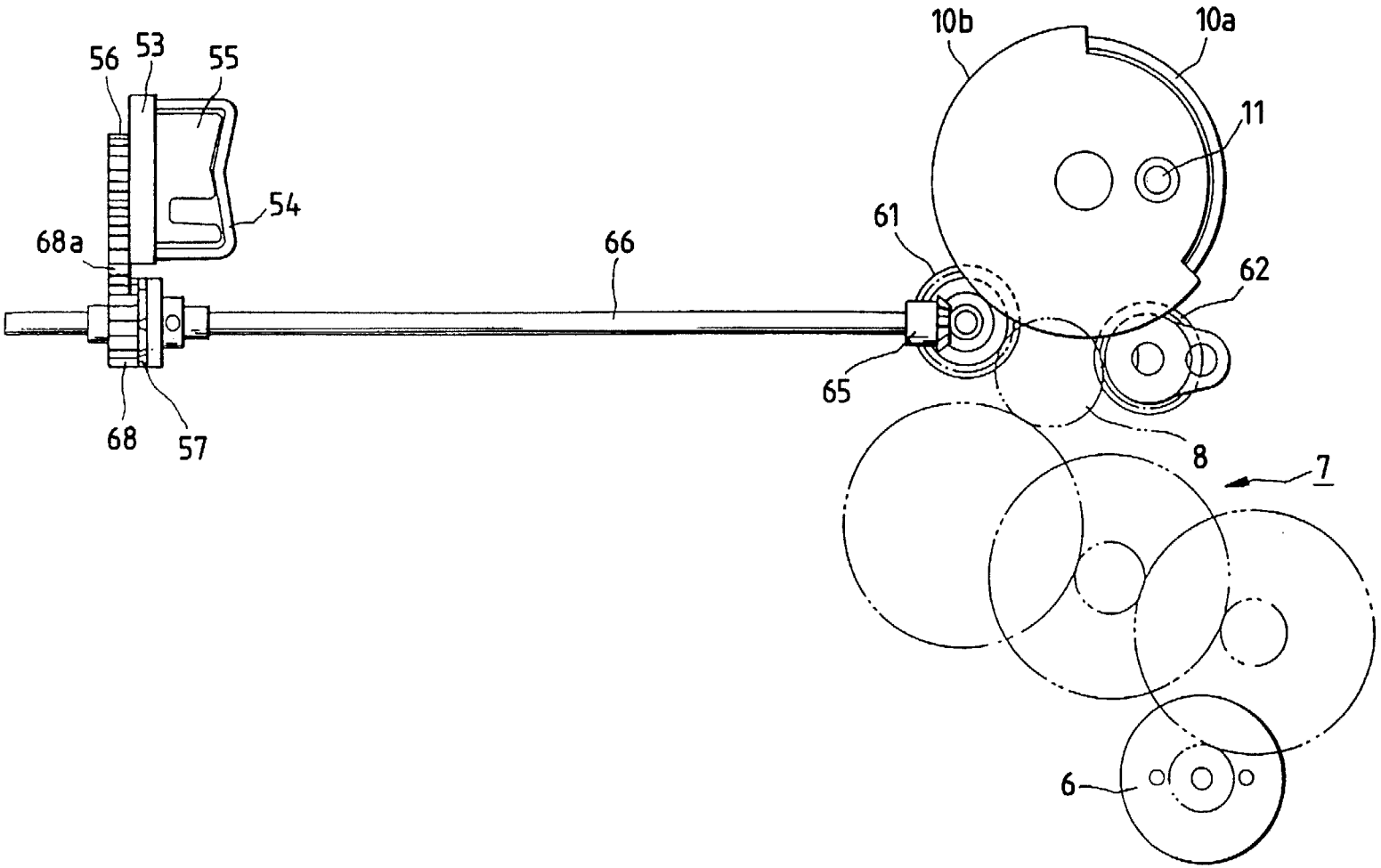
FIGS. 21 and 22 are a side view and a plan view of a power transmitting system, respectively.
Figure 22:
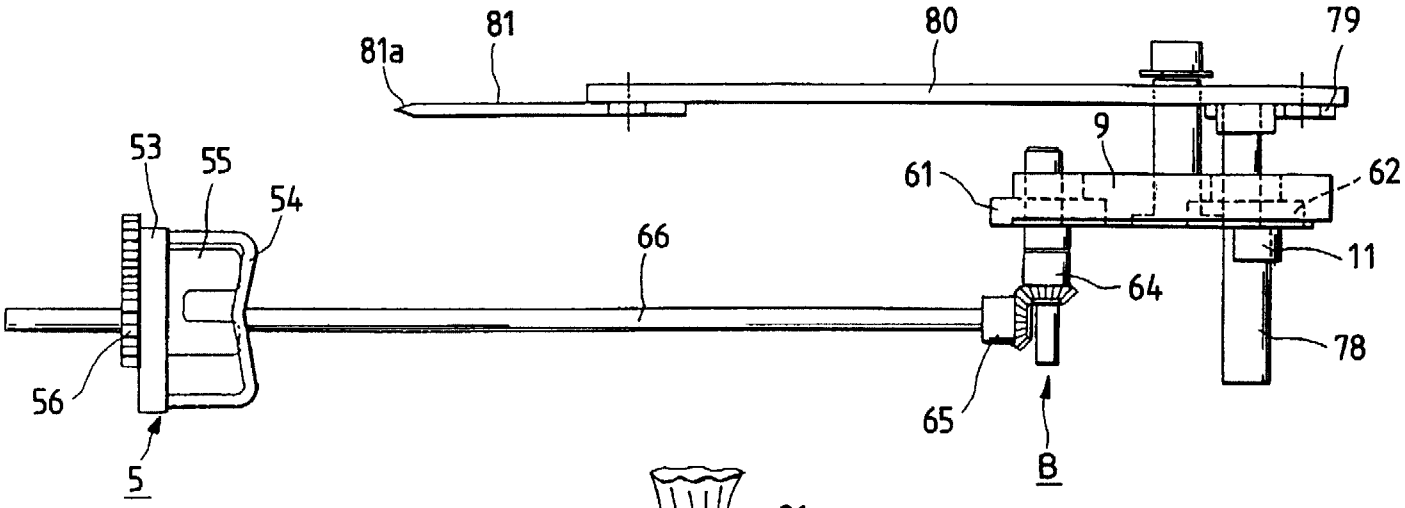
Figure 23:
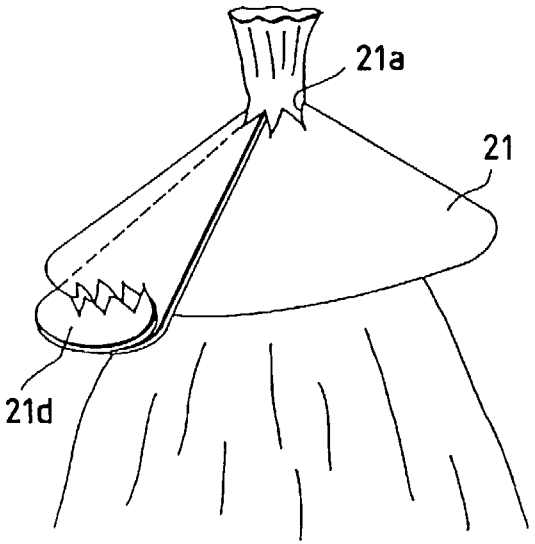
FIG. 23 is a perspective view showing the binding piece which has bound the mouth of a bag.

As shown in FIGS. 21 and 22, the power transmitting mechanism B for operating the binding-piece engaging mechanism 5 comprises: a bevel gear 64 which is fixedly mounted on the above-described transmission gear 61 in such a manner that it is coaxial with the latter 61; a bevel gear 65 engaged with the bevel gear 64; a twisting coupling rod 66 secured to the bevel gear 65 and extended toward the binding-piece engaging mechanism 5; a pawl clutch 57 mounted on the front end portion of the twisting coupling rod 66, the pawl clutch 57 serving as an overload preventing clutch; and a drive gear 68 which is mounted on the twisting coupling rod 66 in such a manner that it is located in front of the pawl clutch 57 and engaged with the driven gear 56 of the binding-piece engaging mechanism 5. The pawl clutch 57 is a conventional one, which is adapted to protect the crosswise engaging arm 54 of the binding-piece engaging mechanism 5 from overload. The drive gear 68 applies torque to the driven gear 56 of the binding-piece engaging mechanism 5 through an intermediate gear 68a which is rotatably supported on the binding machine body 1. When, in an operation where the binding piece 21 is put on the puckered mouth of the bag and the pair of side wings 21*d* of the binding piece 21 are crosswise engaged with each other, a load greater than a predetermined value is applied to the power transmitting mechanism B, then the pawl clutch 57 operates to disengage the drive gear 68 and the twisting coupling rod 66 from each other so that no power is transmitted through them. This saves the part to which otherwise the load may be applied, the binding-piece engaging mechanism 5, from damage.

Bag Mouth Cutting Mechanism

The essential components of the bag mouth cutting mechanism 12 are arranged on the left side of the binding machine body. As shown in FIGS. 2 and 22, the bag mouth cutting mechanism 12 comprises: a sheath 76 which is fixedly secured to the left side of the binding machine body 1 with pins and screws; the transmission gear 62 which is engaged with the intermittent gear 10 in the main gear assembly 9; a shaft 78, D-shaped in cross section, which is extended across the binding machine body 1; a crank 79 which is coupled to the shaft 78 and set in the sheath 76; a connecting bar 80 which is coupled to the crank 79 and extended forwardly along the sheath 76; and the aforementioned blade-shaped cutter 81 which is pivotally coupled to the end of the connecting bar 80 and is reciprocated back and forth in the sheath 76 by a guide (not shown) provided inside the latter 76. The cutter 81 is reciprocated back and forth near the disengagement preventing recess 16 of the puckering groove 15 on the left side of the binding machine body 1. The cutter 81 has an edge which is so shaped that its lower end is protruded forwardly more than the upper end.

According to the binding machine described above, the binding piece is kept at such a position that the binding piece is substantially conical and that the first opening engaged with the puckered mouth of the bag is at the top when the binding piece is put on the puckered mouth of the bag. Therefore, deformation of the locking wings of the binding piece can be prevented in spite of the reactive force from the puckered mouth of the bag. Accordingly, the binding machine of the invention can stably bind the puckered mouth of the bag with the binding piece which is substantially conical with the convex side thereof being the same direction as the opening of the bag. As a result, the binding piece has a large binding force. If the bag which is bound by the binding machine is hung upside down, no content falls down by its weight from the mouth of the bag.

What is claimed is:

1. A binding machine for binding a puckered mouth of a bag, said binding machine comprising:

a body having a groove therein for placing the puckered mouth of a bag in contact with a binding piece;

a feeding passageway for a binding piece belt, which belt includes binding pieces each of which is a flat plate of elastic material having a first opening substantially at the center into which the puckered mouth of the bag is inserted, a second opening communicated with said-first opening and extended to an outer edge of the flat plate, and a pair of locking wings provided on both sides of said second opening, said binding piece being located at the top of the binding piece belt on the puckered mouth of a bag to bind the puckered mouth of the bag therewith, said binding-piece feeding passageway having a central axis;

a slider assembly reciprocated in said binding-piece-belt feeding passageway to feed said binding piece to a front end of said binding-piece-belt feeding passageway, said slider assembly including means for curving said binding piece;

a binding-piece engaging mechanism provided at the front end of said binding-piece-belt feeding passageway including a crosswise engaging arm which is rotatable, and a pair of jigs which are fixed;

means for holding said crosswise engaging arm in a predetermined angular position with respect to said jigs; and means for rotating said crosswise engaging arm, wherein said crosswise engaging arm is extended rearwardly from the front end of said binding-piece-belt feeding passageway when said crosswise engaging arm is held at said predetermined angular position, said pair of locking wings of said binding piece are inserted into said binding-piece engaging mechanism by said slider assembly in such a manner that said locking wings cross said crosswise engaging arm through said second opening, said binding piece engages the puckered mouth of a bag through said first opening, said jigs are set adjacent to and in front of said crosswise engaging arm and, when said crosswise engaging arm is at said predetermined angular position, said jigs are located angularly ahead of said crosswise engaging arm in the direction of rotation of said crosswise engaging arm, and in binding the puckered mouth of the bag with said binding piece, said crosswise engaging arm is rotated by said rotating means around the central axis of said binding-piece-belt feeding passageway from said predetermined angular position so that one of said pair of locking wings of said binding piece, while being in contact with a corresponding one of said pair of jigs, is guided by said corresponding jig in such a manner that said one locking wing is crosswise engaged with said other locking wing which is fixedly supported by the other jig, whereby said binding piece is curved by said curving means in such a manner that after said locking wings are locked to one another said binding piece is substantially conical, the convex side thereof opening in the same direction as the opening of the bag with said first opening engaged with the puckered mouth of the bag at the top.

2. A binding machine employing a binding piece belt, which belt includes a series of binding pieces each of which is a flat plate of elastic material having a first opening substantially at the center into which an object to be bound therewith is inserted, a second opening which is communicated with the first opening and extended to an outer edge of the flat plate, and a pair of locking wings provided on both sides of the second opening, said binding machine operating to put a binding piece located at the top of the binding piece belt on a puckered mouth of a bag and bind the puckered mouth of the bag therewith, said binding machine comprising:

(a) a body having a groove therein for placing the puckered mouth of a bag in contact with a binding piece;

(b) a binding-piece-belt feeding passageway having a central axis;

(c) a slider assembly reciprocated in said binding-piece-belt feeding passageway to feed the binding piece to a front end of said binding-piece-belt feeding passageway, said slider assembly having means for curving said binding pieces;

(d) a binding-piece engaging mechanism provided at the front end of said binding-piece-belt feeding passageway and including a crosswise engaging arm which is rotatable and a pair of jigs which are fixed;

(e) means for holding said crosswise engaging arm in a predetermined angular position with respect to said jigs; and (f) means for rotating said crosswise engaging arm, wherein said crosswise engaging arm is extended rearwardly from the front end of said binding-piece-belt feeding passageway when said crosswise engaging arm is held at said predetermined angular position, the pair of locking wings of the binding piece are inserted into said binding-piece engaging mechanism by said slider assembly in such a manner that the locking wings cross said crosswise engaging arm through the second opening, said binding piece engages the puckered mouth of a bag through the first opening, said jigs are set adjacent to and in front of said crosswise engaging arm and, when said crosswise engaging arm is at said predetermined angular position, said jigs are located angularly ahead of said crosswise engaging arm in the direction of rotation of said crosswise engaging arm, and in binding the puckered mouth of the bag with the binding piece, said crosswise engaging arm is rotated by said rotating means around the central axis of said binding-piece-belt feeding passage way from said predetermined angular position so that one of the pair of locking wings of the binding piece, while being in contact with a corresponding one of said pair of jigs, is guided by said corresponding jig in such a manner that the one locking wing is crosswise engaged with the other locking wing which is fixedly supported by the other jig, whereby the binding piece is curved by said curving means in such a manner that after said locking wings are locked to one another the binding piece is substantially conical and the first opening engaged with the puckered mouth of the bag is at the top.

3. A binding machine for binding a puckered mouth of a bag, said binding machine comprising:

a body having a groove therein for placing the puckered mouth of a bag in contact with a binding piece, a feeding passageway for a binding piece belt, which includes a series of binding pieces each of which is a flat plate of elastic material having a first opening substantially at the center of the flat plate into which the puckered mouth of the bag is inserted, a second opening which is communicated with said first opening and extended to an outer edge of the flat plate, and a pair of locking wings provided on both sides of the second opening, said binding-piece feeding passageway having means for arranging the binding piece in a receiving position before installation on the puckered mouth of the bag in a substantially conical shape, the convex side thereof opening in the same direction as the opening of the bag with said first opening engaged with the puckered mouth of the bag at the top, wherein said means for arranging the binding piece includes a binding piece holder for maintaining said substantially conical shape of said binding piece when said binding piece is installed on the puckered mouth of the bag.

4. A binding machine according to claim 3 further comprising:

a slider assembly reciprocated in said binding-piece-belt feeding passageway to feed said binding piece to a front end of said binding-piece-belt feeding passageway;

a binding-piece engaging mechanism provided at the front end of said binding-piece-belt feeding passageway including a crosswise engaging arm which is rotatable, and a pair of jigs which are fixed;

means for holding said crosswise engaging arm in a predetermined angular position with respect to said jigs; and means for rotating said crosswise engaging arm, wherein said binding-piece-belt feeding passageway has a central axis, said crosswise engaging arm is extended rearwardly from the front end of said binding-piece-belt feeding passageway when said crosswise engaging arm is held at said predetermined angular position, said pair of locking wings of said binding piece are inserted into said binding piece engaging mechanism by said slider assembly in such a manner that said locking wings cross said crosswise engaging arm through said second opening, said binding piece engages the puckered mouth of a bag through said first opening, said jigs are set adjacent to and in front of said crosswise engaging arm and, when said crosswise engaging arm is at said predetermined angular position, said jigs are located angularly ahead of said crosswise engaging arm in the direction of rotation of said crosswise engaging arm, and in binding the puckered mouth of the bag with said binding piece, said crosswise engaging arm is rotated by said rotating means around the central axis of said binding-piece-belt feeding passageway from said predetermined angular position, so that one of said pair of locking wings of said binding piece, while being in contact with a corresponding one of said pair of jigs, is guided by said corresponding jig in such a manner that said one locking wing is crosswise engaged with said other locking wing which is fixedly supported by the other jig.

5. A binding machine employing a binding piece belt, which belt includes a series of binding pieces each of which is a flat plate of elastic material having a first opening substantially at the center of the flat plate into which an object to be bound therewith is inserted, a second opening which is communicated with the first opening and extended to an outer edge of the flat plate, and a pair of locking wings provided on both sides of the second opening, the binding machine operating to put the binding piece located at the top of the binding piece belt on a puckered mouth of a bag and bind the puckered mouth of the bag in such a manner that after the binding piece is installed on the bag the binding piece is substantially conical and the first opening engaged with the puckered mouth of the bag is at the top, said binding machine comprising:

(a) a body having a groove therein for placing the puckered mouth of a bag in contact with a binding piece, (b) a binding-piece belt feeding mechanism having means for arranging the binding piece in a receiving position before installation on the puckered mouth in a substantially conical shape, the convex side thereof opening in the same direction as the opening of the bag with the first opening engaged with the puckered mouth of the bag at the top; and (c) a binding piece holder for maintaining said substantially conical shape of the binding piece when the binding piece is installed on the puckered mouth of the bag.

* * * * *